US005471913A

United States Patent [19]

Margittai

[11] Patent Number: 5,471,913

[45] Date of Patent: Dec. 5, 1995

[54] APPARATUS FOR HEATING, MIXING, AND SEALING A FLUID

[76] Inventor: Thomas B. Margittai, 778 Cornwall Dr., State College, Pa. 16801

[21] Appl. No.: 230,907

[22] Filed: Apr. 21, 1994

[51] Int. Cl.[6] ..... F28F 3/08

[52] U.S. Cl. ..... 99/348; 99/452; 165/167

[58] Field of Search ..... 99/348, 452, 453; 165/165–167; 366/144, 147

[56] References Cited

U.S. PATENT DOCUMENTS

| | | | |
|---|---|---|---|
| 3,228,465 | 1/1966 | Vadot | 165/167 |
| 4,359,087 | 11/1982 | Johansson | 165/167 |
| 4,630,674 | 12/1986 | Skoog | 165/167 X |
| 4,744,414 | 5/1988 | Schon | 165/167 |
| 4,976,313 | 12/1990 | Dahlgren et al. | 165/167 |
| 5,099,915 | 3/1992 | VanDyke | 165/166 |
| 5,178,207 | 1/1993 | Bergqvist et al. | 165/167 |
| 5,327,958 | 7/1994 | Machata et al. | 165/167 |
| 5,343,936 | 9/1994 | Beatenbough et al. | 165/167 X |

OTHER PUBLICATIONS

Continuation–in–Part U.S. Pat. App., Ser. No. 08/033/760, filed May 4, 1993 by Thomas B. Margittai.

EPO Publication No. 0579073A1, Date of Publication Jan. 1, 1994 by Thomas B. Margittai.

*Primary Examiner*—David Scherbel
*Assistant Examiner*—Patrick F. Brinson
*Attorney, Agent, or Firm*—Ratner & Prestia

[57] ABSTRACT

A processor for heating and mixing a liquid product, without changing the chemical and other characteristics of the product, includes a plurality of planar elements, or plates, having a thickness sufficient to be mechanically machined and each having a first fluid flow path defined by a groove formed on the top surface of the planar element. Each planar element includes a second fluid flow path which is isolated from the first fluid flow path and defined by a passage extending through the planar element from the top surface to the bottom surface. A mounting system or device mounts the planar elements adjacent one another so that the bottom surface of one planar element is in contact with the top surface of the planar element just below it. In addition, the plates are aligned such that a first fluid, such as a heating medium, will flow between a first and second planar element and a second fluid, such as a liquid product being heated, will flow between a second and third planar element. The design of the first fluid flow path formed on the top surface may be one of various designs such as a spiral, switch-back curve, oblong spiral or linear.

26 Claims, 14 Drawing Sheets

FIG. 4(a)
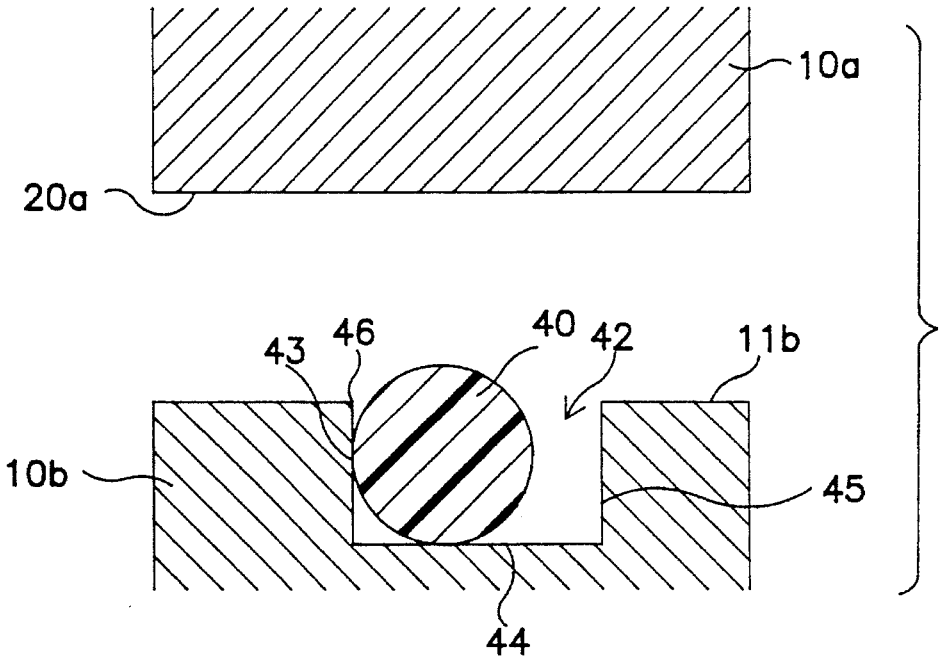
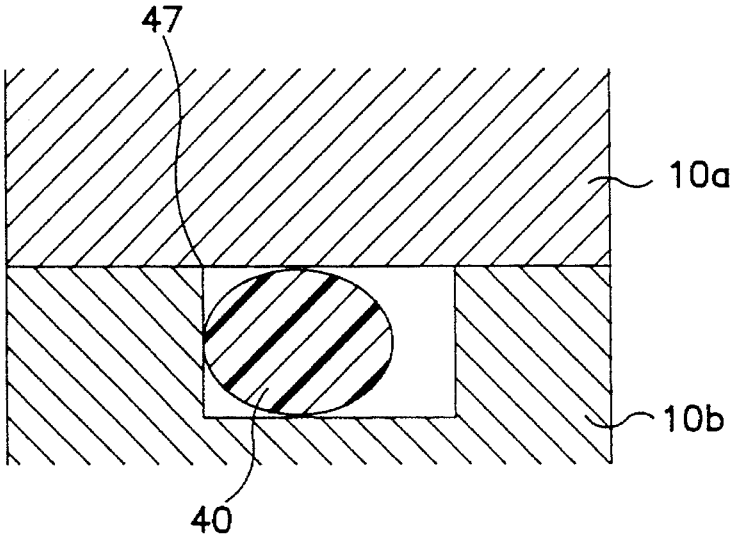
FIG. 4(b)

APPARATUS FOR HEATING, MIXING, AND SEALING A FLUID

FIELD OF THE INVENTION

This invention pertains to an apparatus for heating and mixing delicate products such as food, including soup and milk, pharmaceutical liquids and cosmetic products, without changing the chemical characteristics, nutritional value or taste of the product.

BACKGROUND OF THE INVENTION

Several considerations must be taken into account when heating and mixing delicate liquid products, including liquids having no solid particles, liquids having solid particles and paste. Such liquid products include food, such as soup and milk, pharmaceutical liquids and cosmetic products. For example, milk must be heated during the pasteurization process, and soup must be heated for cooking. In carrying out this processing of the liquid products, changes in the liquid product should be minimized. For example, changes in the chemical characteristics, nutritional value and taste of the product should be minimized. In order to minimize such changes in the characteristics of the product, the deposition of the product on heated surfaces, called "fouling", should be minimized or totally eliminated.

Accordingly, equipment which is used to heat and mix delicate liquid products should preferably apply heat to the product without any significant irregularity in the heat distribution profile. Avoiding a significant irregularity in the heat distribution profile minimizes fouling, which causes the undesirable changes in the characteristics of the product. In addition, such equipment should include a sealing device to avoid loss of the liquid product or heating medium or contamination of the liquid product by the heating medium. Finally, such equipment should be easy to clean in the likely event that some fouling occurs. Even if fouling does not occur, the equipment should be simple to open in order to inspect the interior flow paths because such inspection is typically required at "reasonable intervals" during the processing of food.

The velocity of the liquid product and the shape of the fluid flow path influence whether fouling will occur. For example, a fluid flow path which creates even, complete mixing during the processing of food will minimize fouling. Also, the velocity of the fluid, which is dependent on the pressure used to drive the fluid, can improve the mixing of the product which would minimize fouling.

In order to insure uniform heating to minimize fouling, one approach is to use scraped surface mixers, which are presently being built as a single unit. These mixers are complex and expensive machines.

Plate and frame heat exchangers are the most widely used processors for heating food, including pasteurizing milk and cooking soup. A plate and frame heat exchanger is made up of a number of thin, pressed metal plates having holes through which conduits pass. A first conduit contains the product being heated and a second conduit contains the heating medium. The conduits have openings along their length selectively positioned such that the two fluids flow in alternating channels between two plates. The plates are ribbed to increase heat transfer. An elastomeric gasket is fitted around the perimeter of the plates, and the plates are clamped together between two end plates.

Plate and frame heat exchangers typically require a large quantity of expensive gaskets to be fitted around the periphery of the plates. Furthermore, significant clamping pressure must be used to compress the plates together in order to avoid leakage of either the product or heating medium through the gaskets to the surrounding atmosphere. In addition, the ribs, or undulations, in the flow channel between two plates can cause an area of uneven heat distribution where products might be trapped. This entrapment could lead to fouling in this area. Furthermore, a typical plate and frame heat exchanger is difficult to open and inspect.

Thus, a need exists for a new type of processor which can heat and mix liquid products, such as milk and soup, without causing any change in the characteristics of the liquid products. For example, such a processor should minimize changes in the chemical characteristics, nutritional valve and taste of the liquid products. Such a new processor should be easy to clean and inspect, should have an adequate sealing system and should minimize the amount of sealant required.

SUMMARY OF THE INVENTION

In order to satisfy these and other needs, the present invention is an apparatus for heating and mixing a fluid and includes a plurality of planar elements and a system for mounting planar elements adjacent one another. According to the most general form of the invention, first, second and third planar elements, each of which have a thickness sufficient to be mechanically machined, each include a first fluid flow path formed on the top surface. This first fluid flow path is defined by a groove machined on the top surface of the planar elements extending from a first point to a second point on the planar element. At the first point, a first passage extends into the top surface to the first fluid flow path (but does not extend through the planar element to the bottom surface). At the second point, a second passage extends from the first fluid flow path to the bottom surface of the planar element (but does not extend to the top surface). A second fluid flow path is isolated from the first fluid flow path and is defined by a third passage extending through the planar element from the top surface to the bottom surface.

The mounting system or device mounts the first, second, and third planar elements adjacent one another so that the bottom surface of one of the planar elements is in contact with the top surface of the planar element just below it. Also, the planar elements are aligned such that the second passage of the first planar element is aligned with the third passage of the second planar element and the first passage of the third planar element. Also, the third passage of the first planar element is aligned with the first passage of the second planar element. Finally, the second passage of the second planar element is aligned with the third passage of the third planar element. This permits a first fluid, namely a heating medium such as hot water or steam, to flow in the flow path between the first and second planar elements, while a second fluid, such as a liquid product being heated, flows between the second and third planar elements.

According to an alternative embodiment of the present invention, the apparatus includes only two planar elements and at least one end plate mounted adjacent to either of the two planar elements. The end plate includes two holes which are aligned with the first and second fluid flow paths of the plate adjacent the end plate. The end plate need not have a fluid flow path formed on its top surface. Also, a first pipe coupling element is mounted to the top surface of the end plate at the first hole and a second pipe coupling element as mounted to the top surface of the end plate at the second hole. In addition, the present invention could include a second end plate mounted to the outside surface of the other planar element.

According to another embodiment of the present invention, the present invention includes a plurality of identical planar elements. In one such embodiment, each planar element includes a first fluid flow path defined by a first spiral groove in the top surface extending radially inward from a first point to a central area and a second spiral groove interlaced with the first spiral groove and extending radially outward from the central area to a second point. The second point is 180° from the first point and at the same radial distance from the center as the first point. A second fluid flow path of each planar element is defined by a passage extending through the planar element from the top surface to the bottom surface. This second fluid flow path is disposed 90° from the first and second points and at the same radial distance as the first and second points. The desired alignment of the planar element is achieved by mounting the planar elements to one another and rotating adjacent planar elements 90° relative to one another.

The present invention also includes a novel sealing device for fluids disposed between two contact surfaces. This aspect of the invention has various applications. According to this aspect of the invention, a groove is formed on the top surface of the planar elements radially outward of the first and second fluid flow paths. Similarly, a groove is also formed radially inward of the first and second fluid flow paths. Grooves are also formed on both the top and bottom surfaces surrounding the passage which defines the second fluid flow path. In these grooves rest annular seals, or O-ring seals. Preferably, the cross-sectional diameter of the O-ring seal is slightly greater than the cross-sectional depth of the groove and less than the cross-sectional radial length of the groove. The planar elements are mounted together to form a metal to metal contact, and each O-ring seal abuts against the radially outer corner formed between two adjacent planar elements.

The invention also includes an individual planar element for use in a processor for heating and mixing a fluid. In addition, the invention includes the system including the processor unit, a boiler for heating the heating medium discharged from the unit, as well as fluid flow conduits extending between the boiler and the processor unit for conducting the heating medium between the processor unit and boiler.

BRIEF DESCRIPTION OF THE DRAWINGS

The invention is best understood from the following detailed description when read in connection with the accompanying drawings, in which:

FIG. 4(*a*) is a partial, enlarged cross-sectional view of a groove and an O-ring seal according to the present invention with the adjacent planar elements shown in an expanded position;

FIG. 4(*b*) is a partial, enlarged cross-sectional view of a groove and an O-ring seal according to the present invention with the adjacent planar elements in metal-to-metal contact with one another;

FIG. 5(*b*) is a top plan view of a second planar element according to the second embodiment of the present invention;

FIG. 6(*b*) is a top plan view of a second planar element according to the third embodiment of the present invention;

FIG. 7(*b*) is a top plan view of a second planar element according to the fourth embodiment of the present invention;

FIG. 8(*b*) is a top plan view of a second planar element according to the fifth embodiment of the present invention;

DETAILED DESCRIPTION OF THE INVENTION

Figure 1:
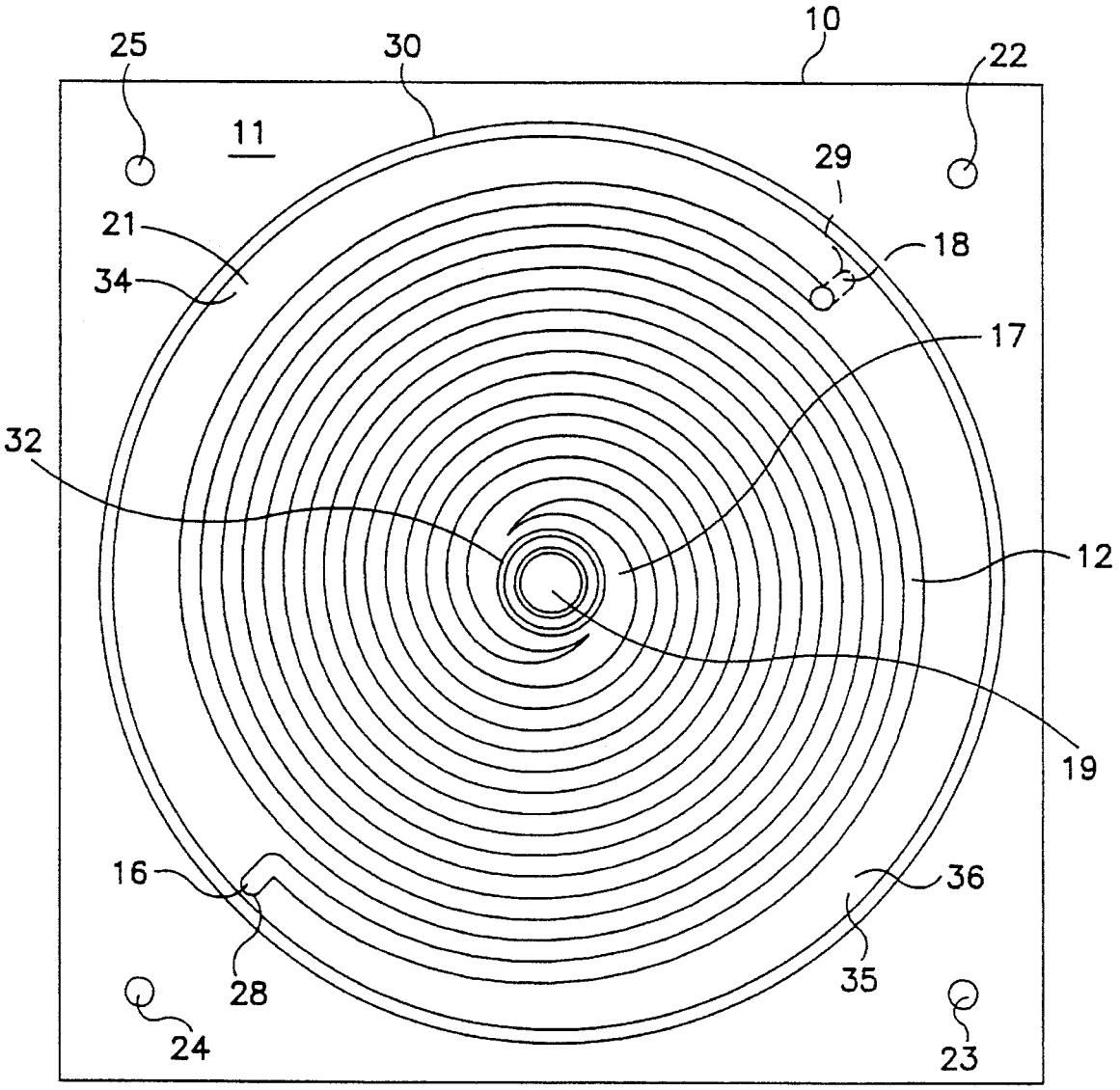
FIG. 1 is a top plan view of a planar element according to a first embodiment of the present invention.
Figure 2:
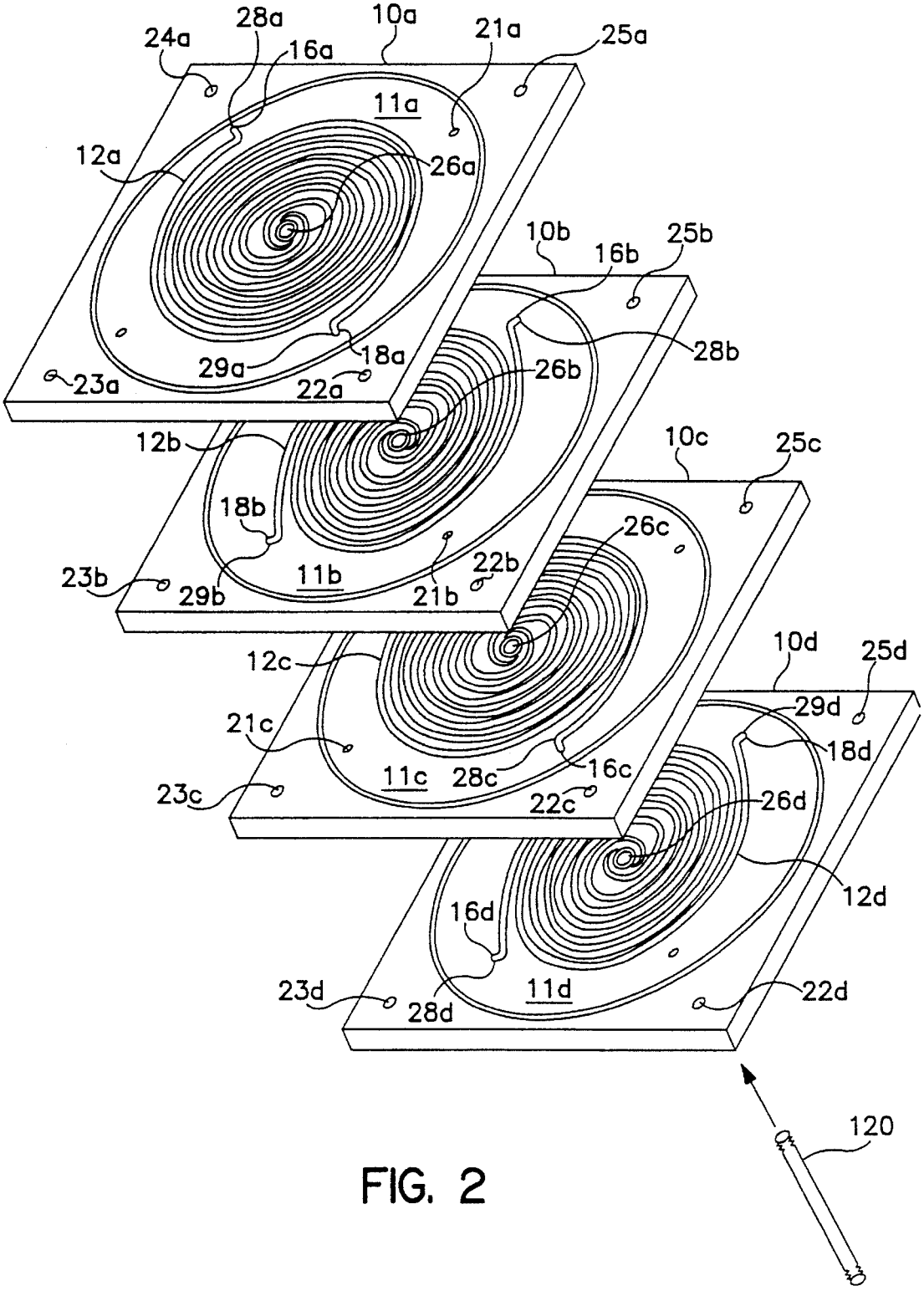
FIG. 2 is an exploded perspective view of four planar elements according to the embodiment shown in FIG. 1.
Figure 3:
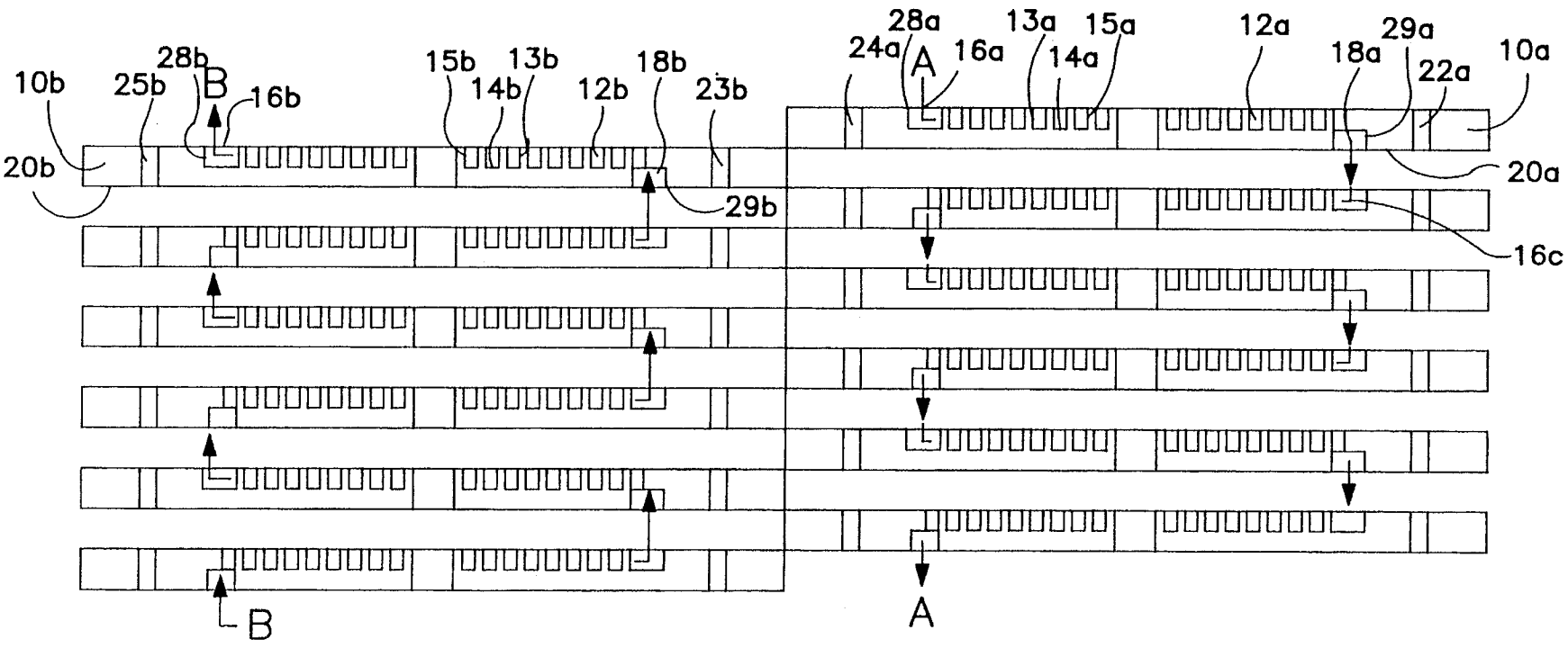
FIG. 3 is a schematic sectional view showing the flow paths of the heating medium and the liquid product in the embodiment according to FIG. 1.

A first embodiment of the present invention is shown in FIGS. 1 through 3. In this embodiment, planar elements 10*a*, 10*b*, 10*c*, and 10*d* are identical, each in the shape of a planar square. The plates for any embodiment may be made of any material suitable for conducting heat between the heating medium and a product. Appropriate materials for the plates include aluminum, stainless steel, nickel, titanium, lead, graphite and ceramics. The specific material should be selected in consideration of the products which will be flowing through the material. For example, metal cannot be used for plates which will be used to heat acid which would degrade a metal plate. The plates should have a thickness sufficient to be mechanically machined. Such a thickness is approximately one-half inch.

A first fluid flow path 12 is formed on the top surface 11 of planar element 10. The bottom surface of each planar element is substantially flat and has no grooves formed therein. First fluid flow path 12 is formed on top surface 11 by machining. The groove formed by the machining process could have various cross-sectional shapes. The grooves shown in FIG. 3 are generally rectangular in cross-section. For example, the groove of planar element 10*a* has a radially outer wall 13*a*, a bottom wall 14*a*, and a radially inner wall 15*a*. It should be noted that FIG. 1 shows a planar element 10 which is identical to any of the planar elements 10*a*, 10*b*, 10*c* and 10*d* shown in FIGS. 2 and 3. Furthermore, each reference numeral associated with the various planar elements includes an appropriate suffix (e.g. a, b, c or d) in order to indicate the planar element with which the item represented by that reference numeral is associated.

The axial depth of the groove of the first fluid flow path depends on the particular heat transfer needs. For example, if a relatively high flow rate is required, then the axial depth of the groove should be greater than if a relatively low flow rate is required. The maximum axial depth of the groove should not exceed that depth which could lead to failure of the remaining portion of the planar element separating the fluid flowing in the first fluid flow path of one planar element with the fluid flowing in the first fluid flow path of an adjacent planar element. This maximum depth is approximately 80% of the thickness of the planar element, depending on the strength of the material used. In general, the axial depth of the groove may be from about 30% to 80% of the thickness of the planar element and preferably from about 70% to 80%. Furthermore, with a more viscous fluid, the cross-sectional area of the groove should be greater.

First fluid flow path 12 starts from a first point 16 at which a first passage 28 is machined into top surface 11 of planar element 10 to extend to first fluid flow path 12. Thus, first passage 28 is in fluid communication with first fluid flow path 12. FIG. 3, which shows a sectional view along a diagonal line of the planar elements which intersects first point 16 and a second point 18, most clearly shows that first point 16*a* is disposed slightly radially outward of the remainder of first fluid flow path 12*a*. At second point 18, a second passage 29 is machined into the bottom surface to first fluid flow path 12. Thus, second passage 29 is in fluid communication with first fluid flow path 12.

Referring again to FIG. 1, first fluid flow path 12 is in the shape of two spiral grooves interlaced with one another. The first spiral groove starts from a point just radially inward of point 16 and spirals inward to a central area 17. From central area 17, the first fluid flow path 12 then extends radially outward along a second spiral groove to a second point 18 which is disposed 180° from first point 16 and at the same radial distance from the center 19 of the planar element 10 as the radial distance between center 19 of planar element 10 and first point 16. As shown best in FIG. 3, a passage is formed on the bottom surface 20*a*, 20*b* of each planar element. At second point 18*a* the groove does not extend through top surface 11*a* but does extend through bottom surface 20*a* of planar element 10*a*. Similar to the relationship of first point 16*a* to first fluid flow path 12*a*, second point 18*a* is disposed slightly radially outward of first fluid flow path 12*a*.

As shown in FIGS. 1 and 2, each planar element 10 includes a second fluid flow path defined by a passage 21 which extends through the planar element from top surface 11 to bottom surface 20. Passage 21 is disposed 90° from first point 16 and second point 18 and at the same radial distance from center 19 as the radial distance between center 19 and first point 16 and second point 18. Passage 21 is not shown in FIG. 3 because it is 90° from the diagonal line used as the cross-sectional line for FIG. 3 and, therefore, out of the plane of the drawing.

Each planar element 10 also includes outer bolt holes 22, 23, 24 and 25. In this embodiment, outer bolt holes 22, 23, 24 and 25 are disposed near each of the corners of the planar element. In order to mount planar elements 10*a*, 10*b*, 10*c* and 10*d* to one another, these bolt holes are aligned and bolts are inserted through the aligned bolt holes to fasten the planar elements to one another. One such bolt 120 (shown in FIG. 2) is threaded at both ends so that a nut 130 (shown in FIG. 9) can be engaged with it. Similarly, a central bolt hole 26 is disposed at center 19 of planar element 10 and a central bolt is inserted through aligned central bolt holes 26*a*, 26*b*, 26*c* and 26*d* to fasten planar elements 10*a*, 10*b*, 10*c* and 10*d* together. For clarity, only one bolt has been shown in FIG. 2, although such a processor could include five such bolts, one each through bolt holes 22–26. Other conventionally used fastening devices, such as a vice grip, can be used to fasten the planar elements together.

The relative alignment of planar elements 10*a*, 10*b*, 10*c* and 10*d* is best shown in FIG. 2. Planar element 10*b* is displaced 90° clockwise from planar element 10*a*. Similarly, planar element 10*c* is displaced 90° clockwise from planar element 10*b*. Also, planar element 10*d* is displaced 90° clockwise from planar element 10*c*. Thus, second point 18*a* of first planar element 10*a* is aligned with third passage 21*b* of second planar element 10*b* and first point 16*c* of third planar element 10*c*. Also, third passage 21*a* of first planar element 10*a* is aligned with first point 16*b* of second planar element 10*b*. Second point 18*b* of second planar element 10*b* is aligned with third passage 21*c* of third planar element 10*c* and first point 16*d* of fourth planar element 10*d*. Second point 18*c* of the third planar element 10*c* is aligned with the third passage 21*d* of fourth planar element 10*d*.

Three planar elements are the minimum number of plates required to define two fluid flow paths for accommodating two fluids, a heating medium and a liquid product. Alternatively, two planar elements can be used with an end plate (discussed in more detail below in connection with FIG. 9). There is no specific maximum number of plates. The sequence of four plates shown in FIG. 2 can be repeated as many times as needed to accomplish the desired heat transfer.

Figure 9:
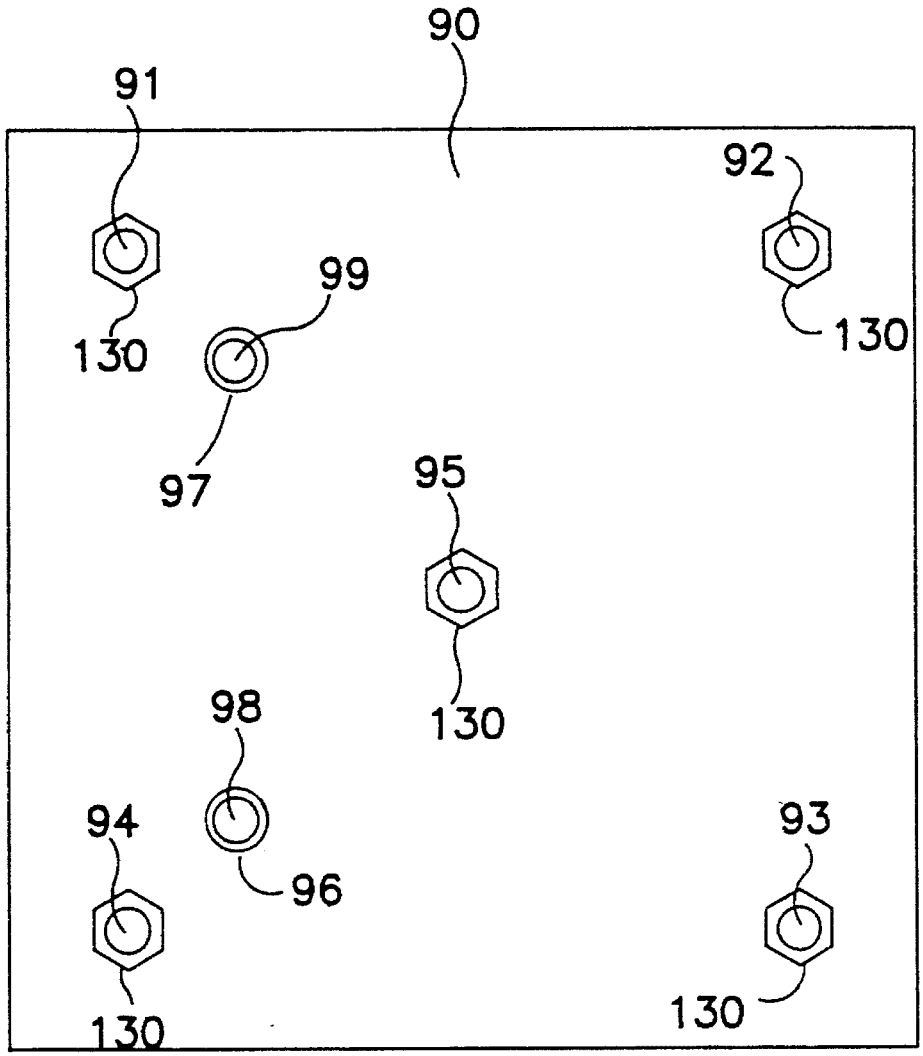
FIG. 9 is a top plan view of an end plate for use in connection with the embodiment shown in FIG. 1.

In operation, a heating medium, such as steam or hot water, is introduced under pressure into first fluid flow path 12*a* of first planar element 10*a* by way of a first passage 28*a* (or inlet passage) at point 16*a*. An end plate, shown in FIG. 9, is used to introduce the heating medium to the first fluid flow path of the first planar element. For example, as shown in FIG. 9, end plate 90 includes four outer bolt holes 91, 92, 93 and 94 and central bolt hole 95. End plate 90 can be mounted onto top surface 11*a* of first planar element 10*a*. Extending through end plate 90 are two passages 96, 97. A first pipe coupling 98 and a second pipe coupling 99 are respectively mounted to the top surface of end plate 90 at first passage 96 and second passage 97. Conventional pipe couplings, such as a short threaded steel conduit which engages a thread formed within the passages 96, 97, may be used. In addition, the pipe coupling should be capable of rigidly engaging conduits for conducting the heating medium and liquid product. For example, hot water or steam could be conducted through a conduit (not shown in FIG. 9) which is attached to pipe coupling 99 through passage 97 and into first fluid flow path 12*a* via the inlet at point 16*a*. The fluid flow path of the heating medium is shown by the arrows labeled A in FIG. 3.

The heating medium then flows inward through the first spiral groove to central area 17 and then outward through the second spiral groove interlaced with the first spiral groove to the outlet passage 29*a* at second point 18*a*. Heat from the heating medium is transferred to the liquid product through planar element 10*a* to the fluid flow path 12*b* on planar element 10*b*. Heating medium from the outlet at point 18*a* is conducted through passage 21*b* of planar element 10*b* and into the inlet of planar element 10*c* at point 16*c*. This flow of the heating medium is continued such that the heating medium flows through the fluid flow paths of every other planar element. An end plate, similar to the end plate shown in FIG. 9, is attached to the bottom surface of the lower-most planar element. Conduits can be attached to pipe couplings formed on such end plates to conduct the heating medium away from the processor.

The fluid flow path of the liquid product may be concurrent or counter-current to the flow direction of the heating medium. As shown in FIG. 3, the liquid product flow path B is counter-current to the flow path A of the heating medium. This liquid product flows through the bottom end plate and is introduced under pressure into a passage 29 at point 18 of the lower most planar element 10. The liquid product would flow throughout the fluid flow path 12 of the lower-most planar element 10 and out through the passage 28 at point 16, through the passage 21 of the adjacent planar element 10, and into the fluid flow path of the next planar element 10. The liquid product may be introduced at the top of the processor and flow downward, while the heating medium, such as steam or hot water, may be introduced at the bottom and flow upward.

Preferably, in order to minimize fouling, third passage 21 has a smaller cross-sectional area than the cross-sectional area of first fluid flow path 12 of each planar element 10. In this way, a turbulent flow will result as the fluid flows from planar element to planar element. In addition, the fluid flow path should be free of surface undulations to avoid an area where a fluid might be subject to overheating and fouling.

The liquids which can be heated and mixed by a processor of the present invention include various types of food, such as milk and soup, pharmaceutical products, delicate chemical products and cosmetic products. The processor can be used to heat and mix various liquids which must be heated uniformly and well mixed without changing the nature of the product. Furthermore, the liquid which is heated by the processor of the present invention may contain solid particles, such as the meat and vegetables in soup.

In order to clean or visually inspect the processor, the bolts are loosened and the individual planar elements 10 are separated from one another. The plates can be easily visually inspected for debris or residue caused by fouling. It is believed that a processor according to this embodiment could be operated for nearly double the time without stopping operation for visual inspection for the same process conditions than the time for a plate and frame processor.

Because adjacent planar elements 10 are in metal-to-metal contact with one another, the heating medium and the liquid product will not easily leak away from their appropriate fluid flow paths. Nonetheless, the present invention also can include additional seals. In particular, the embodiment shown in FIG. 1 includes a first circular groove 30 machined on the top surface 11 of the planar element radially outward of first fluid flow path 12 and third passage 21. First circular groove 30 is radially inward of outer bolt holes 22, 23, 24 and 25. A first O-ring seal is disposed in this groove prior to mounting the plates adjacent one another. This O-ring seal and groove configuration prevent fluid from leaking from the first fluid flow path to the surrounding atmosphere. The O-ring seals used in this invention may be conventional O-ring seals, such as an elastic material.

In addition, the embodiment shown in FIGS. 1, and 3 includes a second circular groove 32 which is disposed in central area 17 radially inward of the ends of the spiral grooves, but radially outward of center 19. A second O-ring seal is placed in second circular groove 32 for preventing fluid flow between central area 17 and center 19.

Furthermore, the present invention may include a third circular groove 34 formed on the top surface 11 of the planar elements 10 and surrounding third passage 21. Similar to the sealing methods as before, an O-ring seal fits within this groove for preventing cross contamination between the heating medium and the liquid product. Also, a groove is preferably formed on the bottom surface of planar element 10 which is the same size as groove 34 and also surrounds passage 21.

The processor of the present invention may also include a fourth passage 35 extending through planar element 10 from top surface 11 to bottom surface 20. Fourth passage 35 is disposed 90° from first point 16 and second point 18 and 180° from third passage 21 and at the same radial distance as the radial distance between center 19 and first point 16 and second point 18. A fourth circular groove 36 may be machined on top surface 11 of planar element 10 and surrounding fourth passage 35. Similarly, another circular groove may be formed on bottom surface 20 of planar element 10 and surrounding passage 35. O-ring seals are placed on these two grooves to prevent cross contamination between the two fluids.

The relationship between the O-ring seals and the planar elements is most clearly shown in FIGS. 4(*a*) and 4(*b*). FIGS. 4(*a*) and 4(*b*) show an enlarged partial cross section of planar elements 10*a* and 10*b* with an O-ring seal 40 disposed in a groove 42 formed on the top surface 11*b* of planar element 10*b*. FIGS. 4(*a*) and 4(*b*) could represent a cross section of any of the groove and O-ring seals discussed above. Preferably, the O-ring seal 40 has a diameter which is less than the radial length of groove 42. Also, the diameter of O-ring seal 40 is preferably greater than the radial depth of groove 42. In this way, upon mounting planar elements 10*a* and 10*b* together, O-ring seal 40 is compressed and widened so that a larger surface of O-ring seal 40 abuts against bottom surface 20*a* of planar element 10*a*.

The circular groove 42 may be any cross-sectional shape. As shown, the cross section of the circular groove 42 includes a radially outer wall 43, a bottom wall 44 and a radially inner wall 45. The intersection of top surface 11*b* of planar element 10*b* and radially outer wall 43 form an outer peripheral corner 46. Upon mounting planar element 10*a* with planar element 10*b*, bottom surface 20*a* contacts outer peripheral corner 46 to form an enclosed corner 47.

O-ring seal 40 rests in groove 42 with the central vertical axis of O-ring seal 40 perpendicular to the plane defined by top surface 11*b* of planar element 10*b*. As pressure builds up within the interior of planar element 10*b* (to the right as shown in FIG. 4*b*), O-ring seal 40 will tend to abut against enclosed corner 47. In this way, O-ring seal 40 serves as a self-sealing system to prevent leakage in a direction 90° from the central vertical axis of O-ring seal 40. Also, unlike prior art systems, O-ring seal 40 and surrounding elements 10*a* and 10*b* are stationary.

The present invention also includes the sealing arrangement disclosed in FIG. 4 regardless of the particular flow path formed in the top surface of the planar elements or the application of the system. The most general form of this aspect of the invention includes a first and a second member, each having a contact surface positioned against one another. A groove, having a wall, is formed in the contact surface of the second member. A sealant member is disposed in the groove and is distorted from its original shape by compression along an axis perpendicular to the contact surfaces when the contact surfaces are positioned against each other. The height of the sealant member is greater than the depth of the groove prior to distortion. The cross-sectional area of the sealant member is smaller than the cross-sectional area of the groove subsequent to distortion. The sealant member is urged toward the wall of the groove upon exposure to fluid pressure applied in a direction perpendicular to the axis perpendicular to the contact surfaces.

Figure 5A:
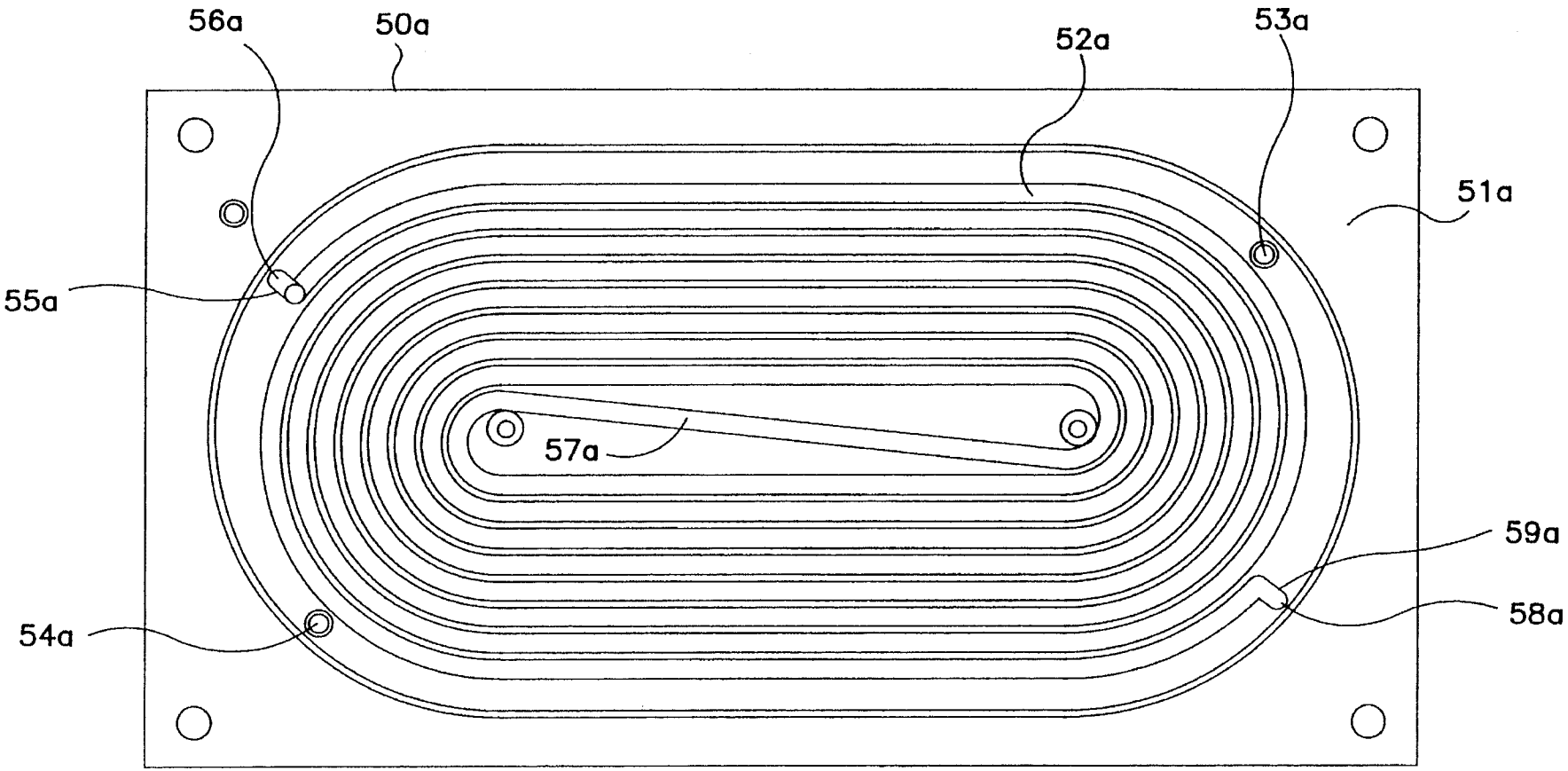
FIG. 5(*a*) is a top plan view of a first planar element according to a second embodiment of the present invention.
Figure 5B:
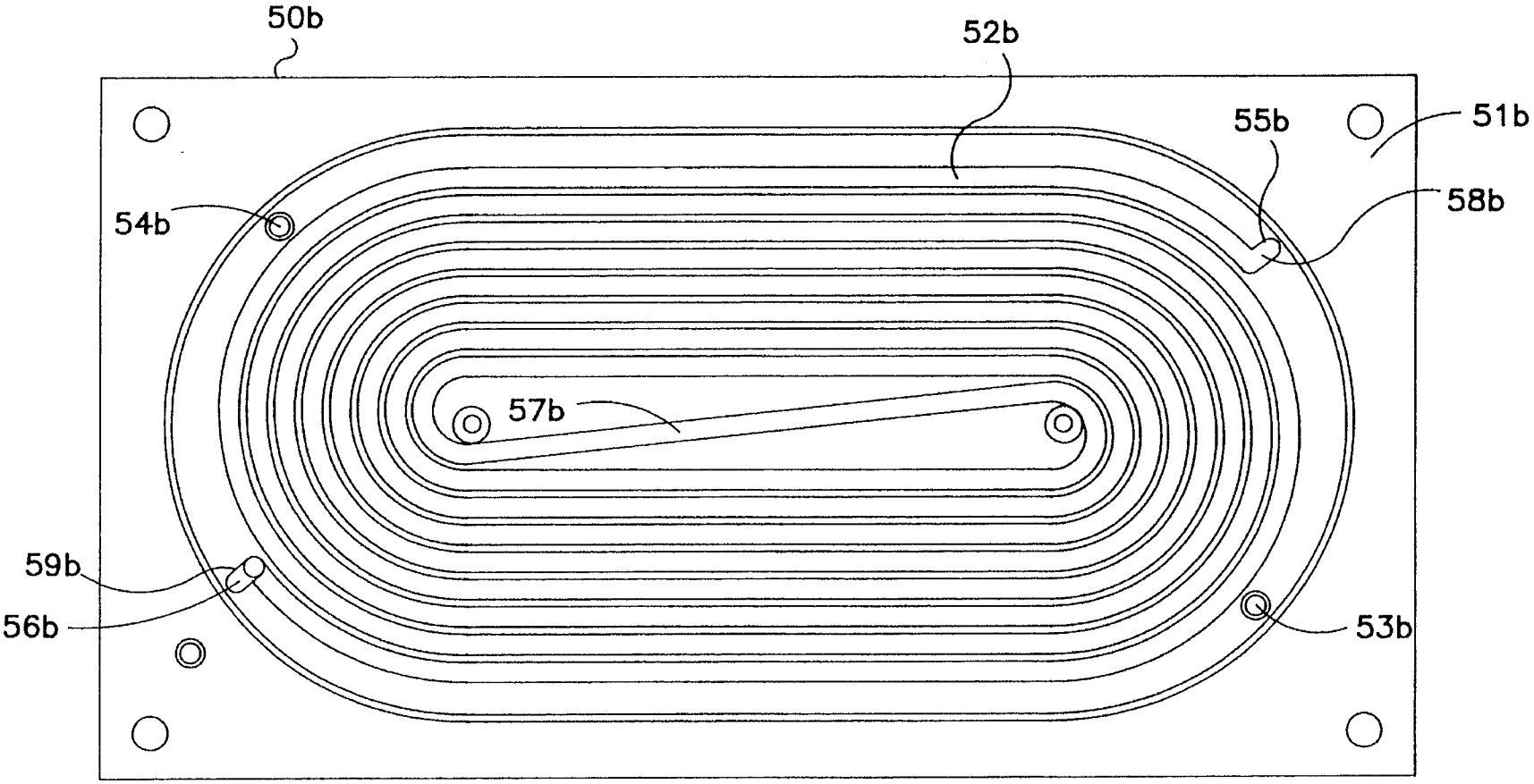

According to the embodiments shown in FIGS. 5(*a*), 5(*b*), 6(*a*) and 6(*b*), two types of planar elements are required for forming the processor, namely a first planar element and its mirror image. Furthermore, according to these two embodiments, the second point of the planar element is 180° from the first point and at the same radial distance from the center of the planar element. The second fluid flow path, defined by a third passage, is symmetrical with the first point relative to a first axis extending through the center of the planar element and bisecting the planar element. This third passage is at a point which is also symmetrical with the second point relative to a second axis perpendicular to the first axis and also extending through the center of the planar element and bisecting the planar element.

In particular, with respect to the embodiment shown in FIGS. 5(*a*) and 5(*b*), a first planar element 50*a* includes a top surface 51*a* and a second planar element 50*b* includes a top surface 51*b*. Each of the planar elements 50*a*, 50*b* include first fluid flow paths 52*a*, 52*b* which are defined by grooves formed on top surfaces 51*a*, 51*b*. The grooves extend as a first oblong spiral from first points 56*a*, 56*b* radially inward to central areas 57*a*, 57*b*. At first points 56*a*, 56*b*, first passages 55*a*, 55*b* extend into top surfaces 51*a*, 51*b* and into first fluid flow paths 52*a*, 52*b*, but do not extend through the bottom surfaces of the planar elements. First fluid flow paths 52*a*, 52*b* then extend radially outward from central areas 57*a*, 57*b* to second points 58*a*, 58*b*, as a second oblong spiral interlaced with the first oblong spiral. At second points 58*a*, 58*b*, second passages 59*a*, 59*b* extend from first fluid flow paths 52*a*, 52*b* through the bottom surfaces of planar elements 50*a*, 50*b*, but do not extend through the top surfaces of the planar elements.

Planar elements 50*a*, 50*b* also include second fluid flow paths defined by either third passages 53*a*, 53*b* or fourth passages 54*a*, 54*b*. These passages are disposed symmetrical with first points 56*a*, 56*b* and second points 58*a*, 58*b*, with respect to the central axes of the planar elements.

Similar to the embodiment shown in FIGS. 1, 2 and 3, the embodiment shown in FIGS. 5(*a*) and 5(*b*) includes four outer bolt holes, a groove surrounding the first fluid flow path, and grooves formed on both the top and bottom surfaces surrounding third passages 53*a*, 53*b* and fourth passages 54*a*, 54*b*. The embodiment according to FIGS. 5(*a*) and 5(*b*) includes two central bolt holes for accommodating two central bolts. Similarly, grooves for accommodating O-ring seals encompass the central bolt holes.

The planar elements 50*a*, 50*b* are aligned relative with one another to achieve the same alternating fluid flow path of heating medium and liquid product as described with respect to the embodiment shown in FIGS. 1, 2 and 3. For example, planar element 50*a* is mounted directly on top of planar element 50*b* such that second passage 59*a* is aligned with third passage 53*b* and fourth passage 54*a* is aligned with first passage 55*b*. The plate in the third position, just below plate 50*b*, is a plate identical to plate 50*a* except rotated 180° from the position of plate 50*a*. Similarly, the plate in the fourth position is a plate identical to plate 50*b* except that it is rotated 180° from the position of plate 50*b*.

An end plate, similar to the end plate shown in FIG. 9, could be used to introduce the heating medium and the liquid product to the processor. Such an end plate would have a shape identical to plates 50*a*, 50*b*, but would not have a first fluid flow path formed on its top surface. Furthermore, such an end plate would include passages to be aligned with fourth passage 54*a* and first passage 55*a*. The embodiment shown FIGS. 5(*a*) and 5(*b*) operates similar to the embodiment shown in FIGS. 1, 2 and 3.

Figure 6A:
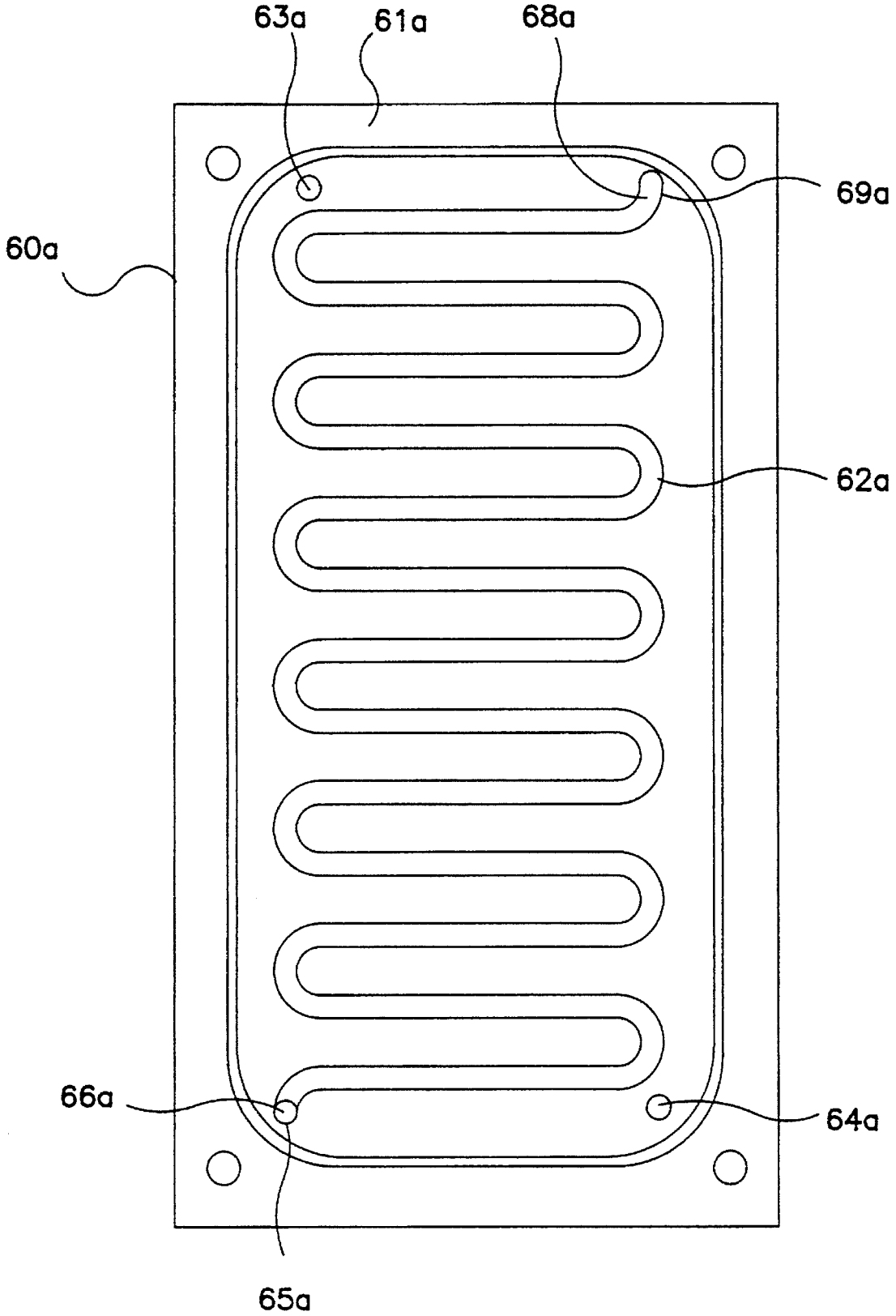
FIG. 6(*a*) is a top plan view of a first planar element according to a third embodiment of the present invention.
Figure 6B:
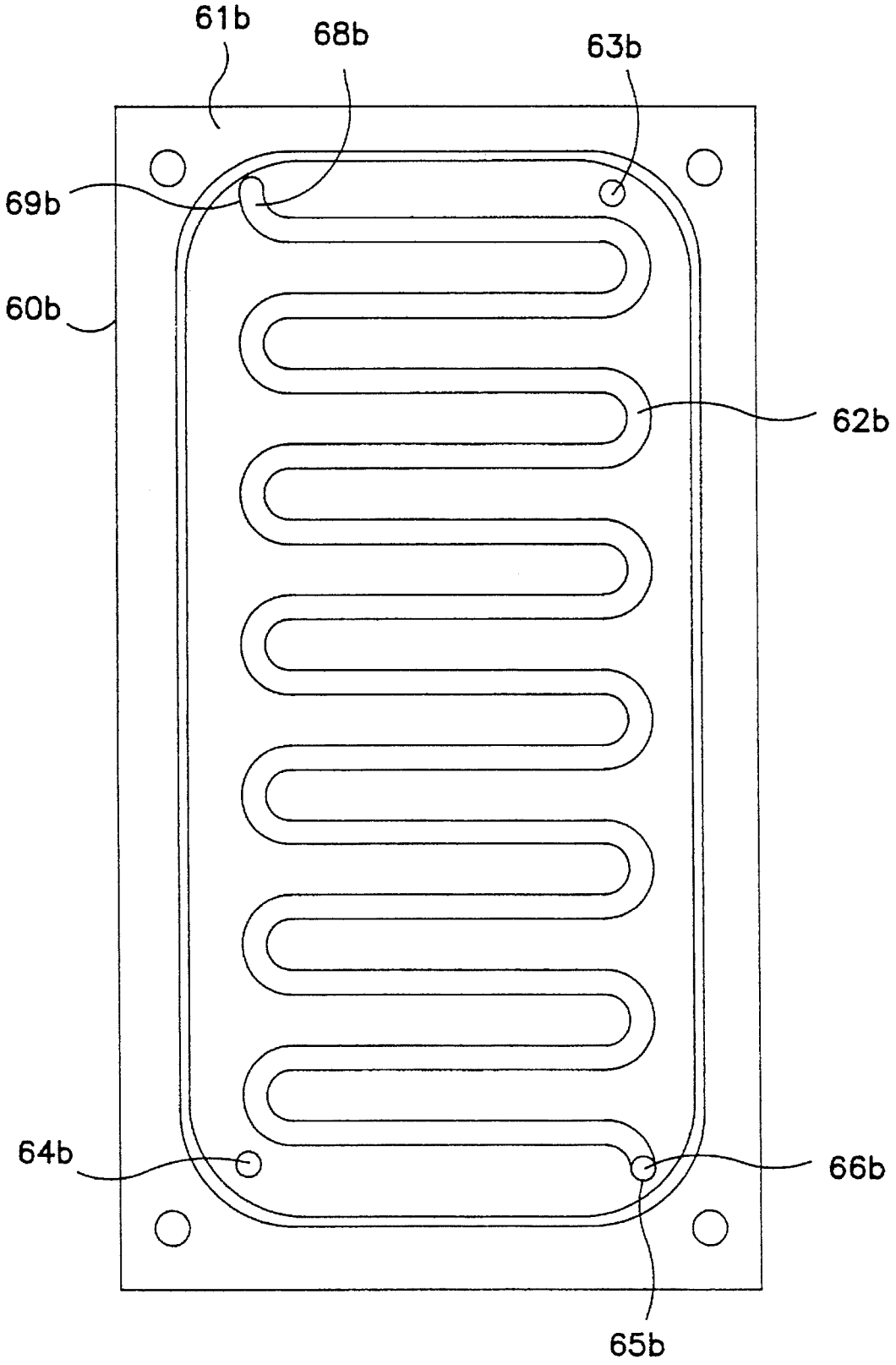

The embodiment shown in FIG. 6(*a*) and 6(*b*) includes planar elements 60*a*, 60*b* having top surfaces 61*a*, 61*b*. Formed on top surfaces 61*a*, 61*b* are first fluid flow paths 62*a*, 62*b*. First fluid flow paths 62*a*, 62*b* extend from a first point 66*a*, 66*b* to a second point 68*a*, 68*b* in the shape of a series of switch-back curves. As before, at first points 66*a*, 66*b*, passages 65*a*, 65*b* extend into top surfaces 61*a*, 61*b* to first fluid flow paths 62*a*, 62*b* but do not extend to the bottom surfaces of planar elements 60*a*, 60*b*. At second points 68*a*, 68*b*, passages 69*a*, 69*b* extend through to the bottom surfaces of planar elements 60*a*, 60*b* but do not extend to top surfaces 61*a*, 61*b*.

Planar elements 60*a*, 60*b* also include a second fluid flow path defined by either third passages 63*a*, 63*b* or fourth passages 64*a*, 64*b*. The grooves, O-ring seals, and the four outer bolt holes are similar to the embodiments discussed before. Also, an end plate may be used in connection with the embodiment shown in FIGS. 6(*a*) and 6(*b*). The relative placement of planar elements is identical with the embodiment shown in FIGS. 5(*a*) and 5(*b*).

Figure 7A:
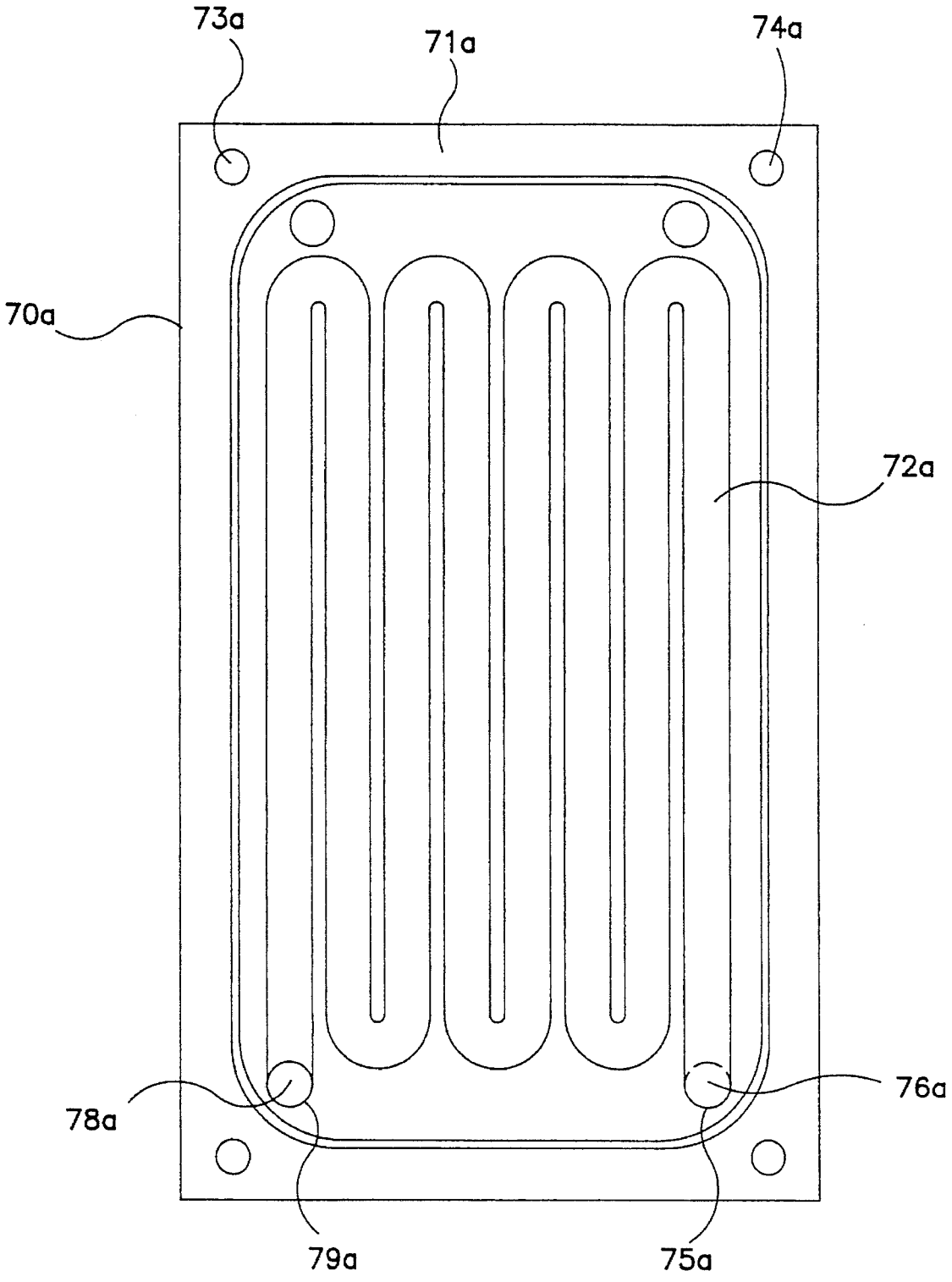
FIG. 7(*a*) is a top plan view of a first planar element according to a fourth embodiment of the present invention.
Figure 7B:
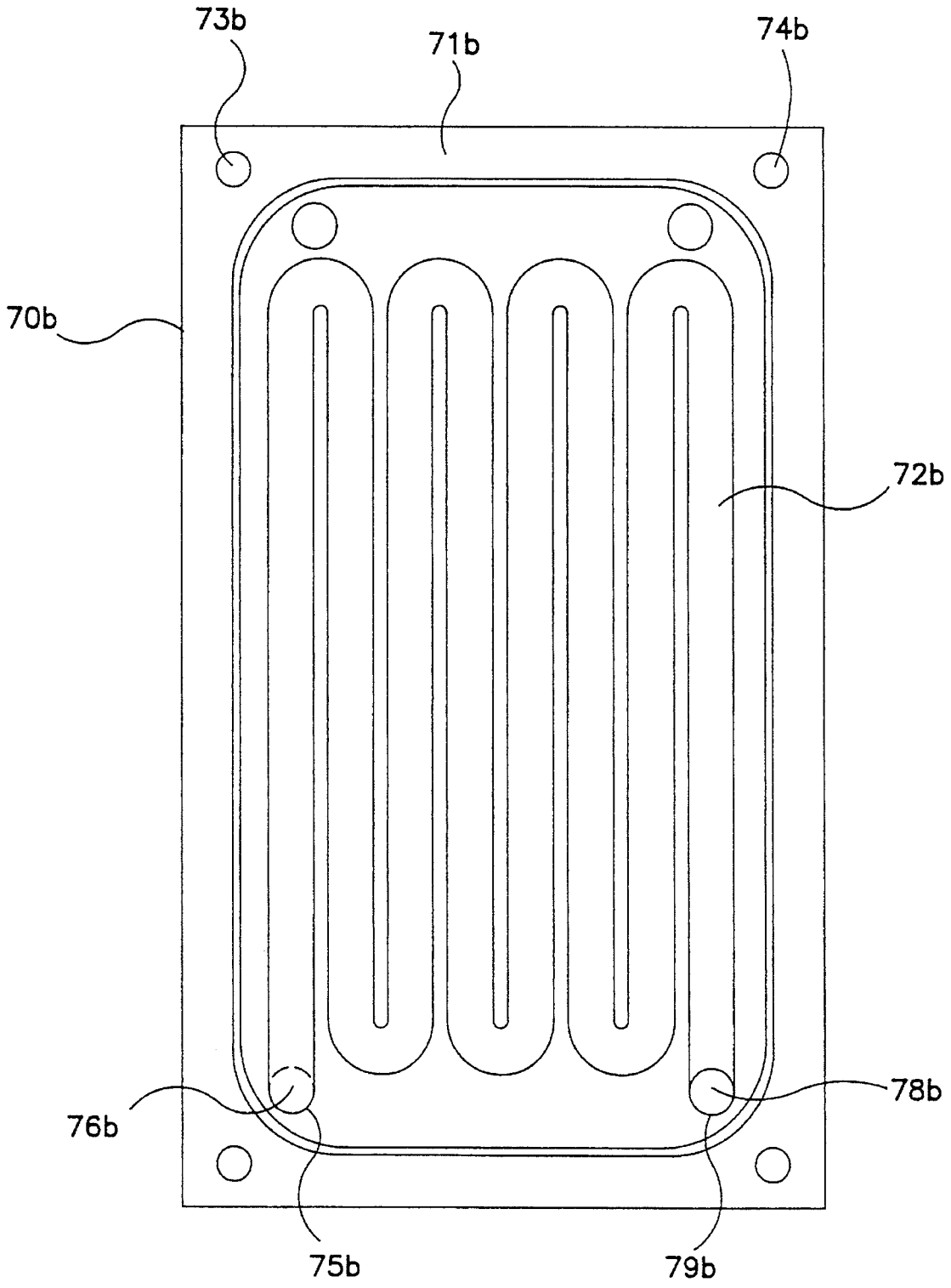

According to the embodiment shown in FIGS. 7(*a*) and 7(*b*), first and second planar elements 70*a*, 70*b* are shown having top surfaces 71*a*, 71*b*. First fluid flow paths 72*a*, 72*b* formed on top surfaces 71*a*, 71*b* are mirror images of one another and extend from first points 76*a*, 76*b* to second points 78*a*, 78*b* as a series of switch-back curves. At first points 76*a*, 76*b*, first passages 75*a*, 75*b* extend into top surfaces 71*a*, 71*b* and into first fluid flow paths 72*a*, 72*b*, but do not extend through the bottom surfaces of the planar elements. At second points 78*a*, 78*b*, second passages 79*a*, 79*b* extend from first fluid flow paths 72*a*, 72*b* through the bottom surfaces of planar elements 70*a*, 70*b*, but do not extend through the top surfaces of the planar elements.

In stacking plates 70*a*, 70*b*, plate 70*a* is in the first position and a plate identical with plate 70*a* is in the second position except it is disposed 180° displaced relative to the plate in the first position. A plate such as plate 70*b* is disposed in the third position and the plate in the fourth position is a plate identical to plate 70*b* except displaced 180° from the position of plate 70*b* in the third position. This permits the desired alternating flow path of heating medium and liquid product.

Planar elements 70*a*, 70*b* also include a second fluid flow path defined by either third passages 73*a*, 73*b* or fourth passages 74*a*, 74*b*. The grooves, O-ring seals and four outer bolt holes are used similar to the embodiments discussed above. Also, an end plate may be used as discussed above.

Figure 8A:
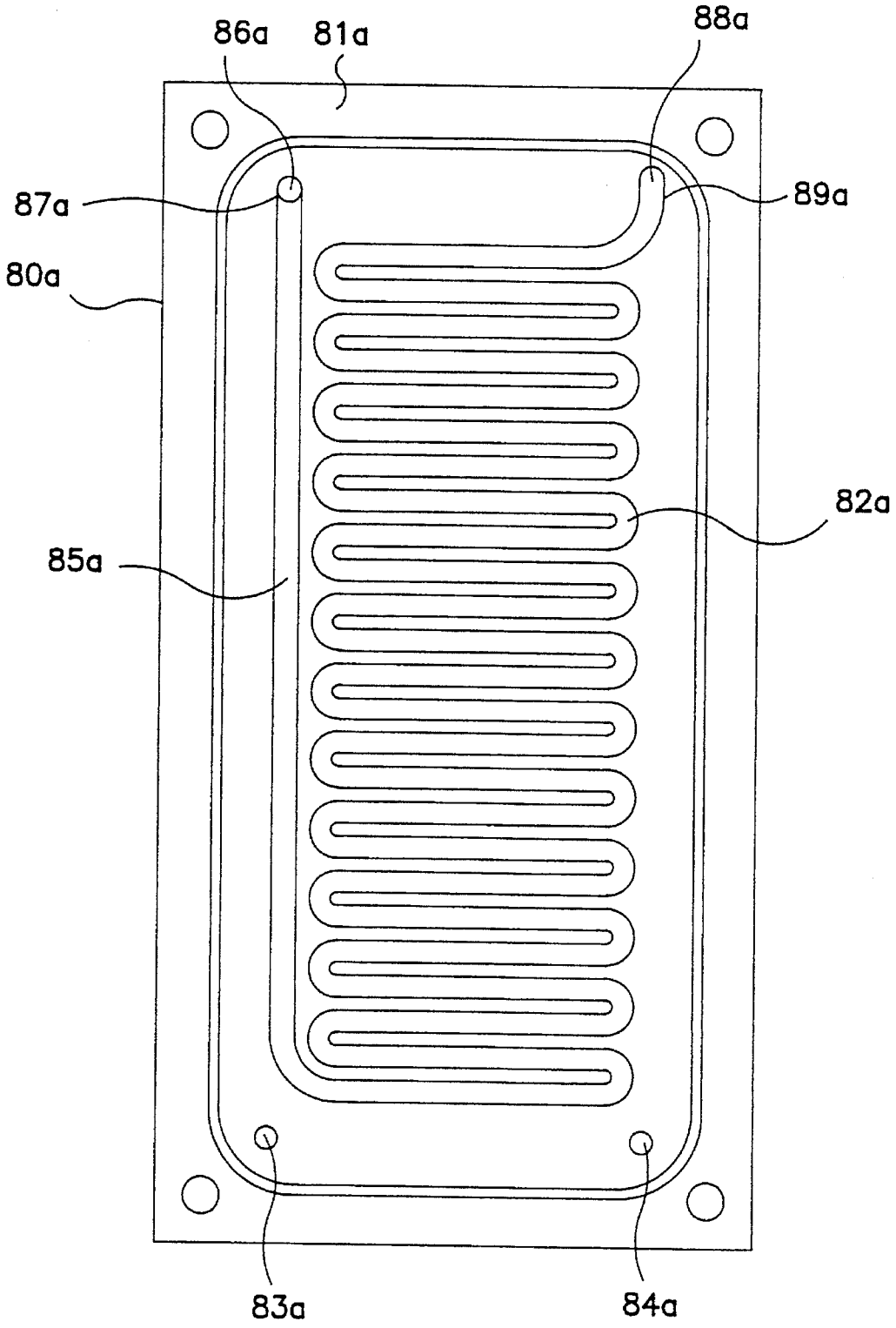
FIG. 8(*a*) is a top plan view of a first planar element according to a fifth embodiment of the present invention.
Figure 8B:
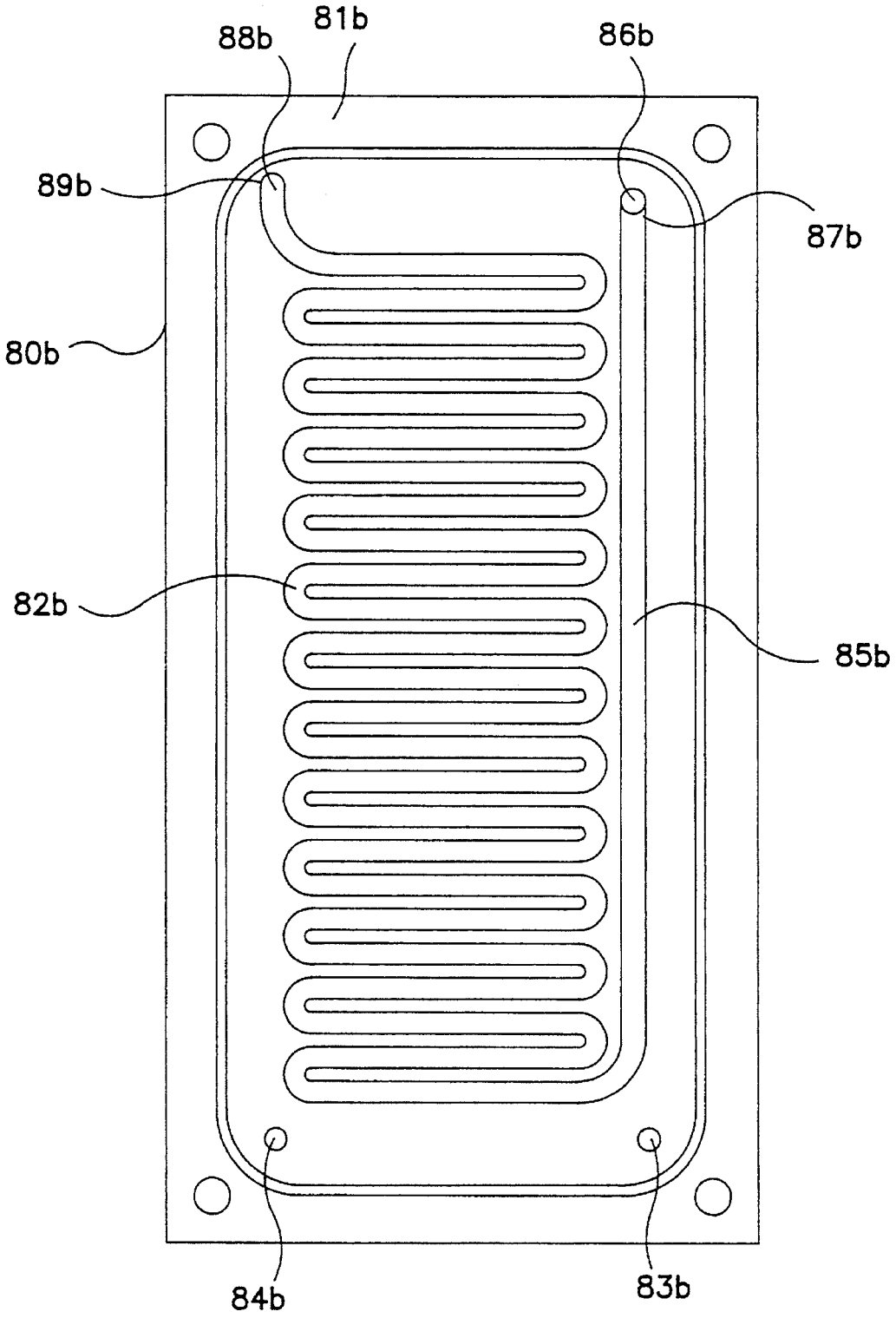

According to the embodiment shown in FIGS. 8(*a*) and 8(*b*), planar elements 80*a*, 80*b* include top surfaces 81*a*, 81*b*. Formed on top surfaces 81*a*, 81*b* are first fluid flow paths 82*a*, 82*b*. First fluid flow paths 82*a*, 82*b* extend from first points 86*a*, 86*b* to second points 88*a*, 88*b*. At first points 86*a*, 86*b*, first passages 87*a*, 87*b* extend into top surfaces 81*a*, 81*b* and into first fluid flow paths 82*a*, 82*b*, but do not extend through the bottom surfaces of the planar elements. At second points 88*a*, 88*b*, second passages 89*a*, 89*b* extend from first fluid flow paths 82*a*, 82*b* through the bottom surfaces of planar elements 80*a*, 80*b*, but do not extend through the top surfaces of the planar elements.

Planar elements 80*a*, 80*b* are in the shape of a rectangle having a length and a width. First points 86*a*, 86*b* are in a first corner and first fluid flow paths 82*a*, 82*b* extend as a straight line 85*a*, 85*b* along the length of the rectangle to a second corner of the rectangle. Then, first fluid flow paths 82*a*, 82*b* extend as a plurality of switch-back curves to second points 88*a*, 88*b* which are at the third corner 180° from the second corner.

The plates of this embodiment are stacked in the same manner as the plates in the embodiment shown in FIGS. 7(*a*) and 7(*b*). Also, the embodiment shown in FIGS. 8(*a*) and 8(*b*) includes the four outer bolt holes, and the grooves for accommodating O-ring seals as discussed before. Furthermore, an end plate may be used in connection with this embodiment.

Figure 10:
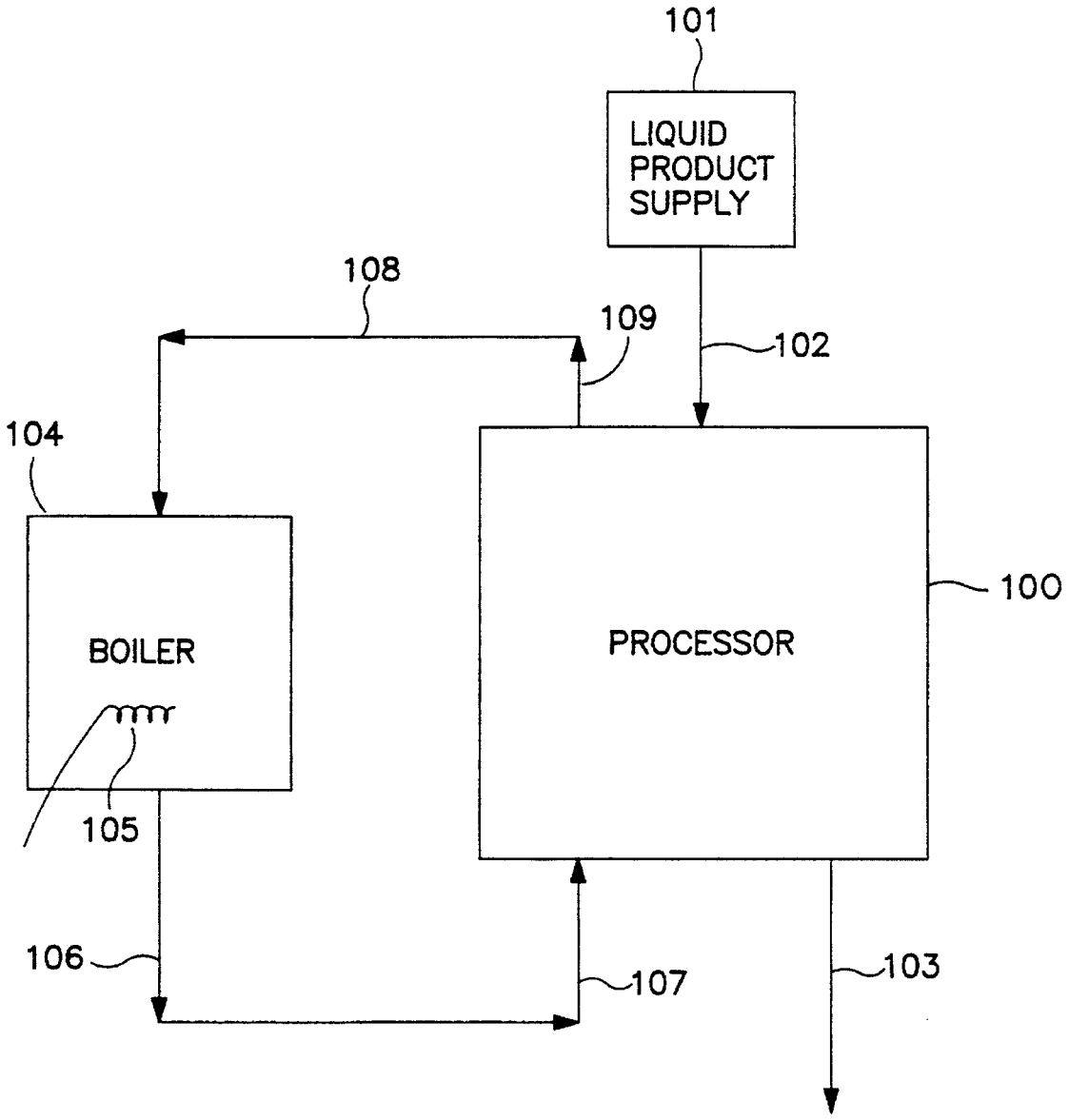
FIG. 10 is a schematic diagram of a system constructed in accordance with the present invention.

FIG. 10 is a schematic view of a system in accordance with the present invention for heating and mixing a fluid. A processor 100 comprises a plurality of planar elements in accordance with any of the embodiments discussed above. Processor 100 includes an end plate on each end of processor 100. Each end plate includes four pipe couplings 102, 103, 107, and 109. A liquid product supply tank 101 introduces a liquid, such as milk to be pasteurized or soup to be cooked, into processor 100 via pipe coupling 102. The treated product exits processor 100 via pipe coupling 103. A boiler 104 is used to reheat the heating medium, for example by using a heating element 105. A first fluid flow conduit 106 extends from boiler 104 to pipe conduit 107 to conduct the heating medium from boiler 104 to processor 100. Also, a second fluid flow conduit 108 extends from pipe coupling 109 to conduct the heating medium from processor 100 back to boiler 104 to be re-heated.

Although illustrated and described herein with reference to certain specific embodiments, the claims are not intended to be limited to the details of the specific embodiments. Rather, the claims should be read to include various modifications of the details of the specific embodiments without departing from the spirit of the invention.

What is claimed:

1. Apparatus for heating and mixing a fluid comprising:

a plurality of planar elements each having:

(a) a first fluid flow path defined by:

(1) a first spiral groove in a top surface of said planar element extending radially inward from a first point on said planar element to a central area of said planar element, (2) a second spiral groove in said top surface of said planar element interlaced with said first spiral groove and extending radially outward from said central area of said planar element to a second point on said planar element 180° from said first point on said planar element and at the same radial distance from the center of said planar element as the radial distance between the center of said planar element and said first point on said planar element, (3) a first passage at said first point on said planar element extending into said top surface of said planar element to said first spiral groove, and (4) a second passage at said second point on said planar element extending from said second spiral groove to a bottom surface of said planar element, and (b) a second fluid flow path defined by a third passage extending through said planar element from said top surface to said bottom surface and disposed 90° from said first and second points on said planar element and at the same radial distance from the center of said planar element as the radial distance between the center of said planar element and said first and said second points on said planar element; and means for mounting said plurality of planar elements adjacent one another with said bottom surface of a first planar element in contact with said top surface of an adjacent second planar element and with said first and second points of said first planar element disposed 90° rotated from said first and second points of said second planar element such that:

(a) said second passage of said first planar element is aligned with said third passage of said second planar element, and (b) said third passage of said first planar element is aligned with said first passage of said second planar element.

2. Apparatus in accordance with claim 2, wherein said plurality of planar elements includes a plurality of sequences of said planar elements, wherein each of said sequences comprises:

(a) said first planar element, (b) said second planar element, (c) a third planar element with said first and second points of said first planar element disposed 180° displaced from said first and second points of said third planar element such that:

(i) said second passage of said second planar element is aligned with said third passage of said third planar element, and (ii) said third passage of said second planar element is aligned with said first passage of said third planar element, and (d) a fourth planar element with said first and second points of said first planar element disposed 270° displaced from said first and second points of said fourth planar element such that:

(i) said second passage of said third planar element is aligned with said third passage of said fourth planar element, and (ii) said third passage of said third planar element is aligned with said first passage of said fourth planar element.

3. Apparatus in accordance with claim 1, wherein each of said planar elements also has a first circular groove in said top surface surrounding said fluid flow path and said apparatus further includes a first O-ring seal in said circular groove.

4. Apparatus in accordance with claim 4, wherein each of said planar elements also has a second circular groove in said top surface radially inward of the ends of said first and said second spiral grooves and said apparatus further includes a second O-ring seal in said second circular groove.

5. Apparatus in accordance with claim 4, wherein said first and second O-rings are comprised of an elastic material.

6. Apparatus in accordance with claim 4, wherein said means for mounting include:

a plurality of outer bolt holes extending through each of said plurality of planar elements and disposed radially outward of said first circular groove, a plurality of outer bolts extending through said plurality of outer bolt holes for attaching said plurality of planar elements to one another;

a central bolt hole extending through each of said plurality of planar elements and disposed at the center and radially inward of said second circular groove, and a central bolt extending through said central bolt hole for attaching said plurality of planar elements to one another.

7. Apparatus in accordance with claim 6, wherein each of said plurality of planar elements is in the shape of a square and includes four outer bolt holes disposed near the four corners of the square.

8. Apparatus in accordance with claim 1, wherein said third passage has a smaller cross-sectional area than the cross-sectional area of the fluid flow path of each of said plurality of planar elements.

9. Apparatus in accordance with claim 1, wherein said fluid flow path is free of surface undulations.

10. Apparatus in accordance with claim 1, wherein said plurality of planar elements are comprised of a material selected from the group consisting of aluminum, stainless steel, titanium, lead, graphite and ceramic.

11. Apparatus in accordance with claim 4, wherein:

each of said plurality of planar elements includes:

(a) a third circular groove formed on said top surface and surrounding said third passage, and (b) a fourth circular groove formed on said bottom surface and surrounding said third passage; and said apparatus further comprises:

(a) a third O-ring seal disposed in said third circular groove, and (b) a fourth O-ring seal disposed in said fourth circular groove.

12. Apparatus in accordance with claim 1, wherein each of said plurality of planar elements includes a third fluid flow path defined by a fourth passage extending through said planar element from said top surface to said bottom surface and disposed 90° from said first and second points on said planar element and 180° from said third passage and at the same radial distance from the center of said planar element as the radial distance between the center of said planar element and said first and said second points on said planar element.

13. A plate for use in a processor for heating and mixing a fluid in the form of a planar element having:

(a) a first fluid flow path defined by:

(1) a first spiral groove in a top surface of said planar element extending inward from a first point on said planar element to a central area of said planar element, (2) a second spiral groove in said top surface of said planar element interlaced with said first spiral groove and extending outward from the central area of said planar element to a second point on said planar element 180° from said first point on said planar element and at the same radial distance from the center of said planar element as the radial distance between the center of said planar element and said first point on said planar element, (3) a first passage at said first point on said planar element extending into said top surface of said planar element to said first spiral groove, (4) a second passage at said second point on said planar element extending from said second spiral groove to a bottom surface of said planar element, and (b) a second fluid flow path defined by a third passage extending through said planar element from said top surface to said bottom surface and disposed 90° from said first and second points on said planar element and at the same radial distance from the center of said planar element as the radial distance between the center of said planar element and said first and said second points on said planar element.

14. Apparatus for heating and mixing a fluid comprising:

a plurality of first planar elements each having:

(a) a first fluid flow path defined by:

(1) a first groove in a top surface of said first planar element extending from a first point on said first planar element to a second point on said first planar element 180° from said first point on said first planar element and at the same radial distance from the center of said first planar element as the radial distance between the center of said first planar element and said first point on said first planar element, (2) a first passage at said first point on said first planar element extending into said top surface of said first planar element to said first fluid flow path, and (3) a second passage at said second point on said first planar element extending from said first fluid flow path to a bottom surface of said first planar element, and (b) a second fluid flow path defined by a third passage extending through said first planar element from said top surface to said bottom surface and disposed at a third point which is:

(1) symmetrical with said first point relative to a first axis extending through the center of said first planar element and bisecting said first planar element, and (2) symmetrical with said second point relative to a second axis, perpendicular to said first axis, and extending through the center of said first planar element and bisecting said first planar element;

a plurality of second planar elements each having:

(a) a first fluid flow path defined by:

(1) a first groove in a top surface of said second planar element extending from a first point on said second planar element to a second point on said second planar element 180° from said first point on said second planar element and at the same radial distance from the center of said second planar element as the radial distance between the center of said second planar element and said first point on said second planar element, (2) a first passage at said first point on said second planar element extending into said top surface of said second planar element to said first fluid flow path, and (3) a second passage at said second point on said second planar element extending from said first fluid flow path to a bottom surface of said second planar element, and (b) a second fluid flow path defined by a third passage extending through said second planar element from said top surface to said bottom surface and disposed at a third point which is:

(1) symmetrical with said first point relative to a first axis extending through the center of said second planar element and bisecting said second planar element, and (2) symmetrical with said second point relative to a second axis, perpendicular to said first axis, and extending through the center of said second planar element and bisecting said second planar element, wherein said first, second and third points of said second planar element are arranged relative to one another as a mirror image with respect to the arrangement of said first, second and third points of said first planar element; and means for mounting said plurality of first and second planar elements adjacent one another by alternately stacking said first planar elements and said second planar elements wherein:

(a) said bottom surface of a first of said first planar elements is in contact with said top surface of an adjacent first of said second planar elements, (b) said bottom surface of said first of said second planar elements is in contact with said top surface of an adjacent second of said first planar elements, and (c) said bottom surface of said second of said first planar elements is in contact with said top surface of an adjacent second of said second planar elements, and wherein said first of said first planar elements is rotated 180° from said second of said first planar elements, and said first of said second planar elements is rotated 180° from said second of said second planar elements such that:

(a) said second passage of said first of said first planar elements is aligned with said third passage of said first of said second planar elements and said first passage of said second of said first planar elements, (b) said third passage of said first of said first planar elements is aligned with said first passage of said first of said second planar elements, (c) said second passage of said first of said second planar elements is aligned with said third passage of said second of said first planar elements and said first passage of said second of said second planar elements, and (d) said second passage of said second of said first planar elements is aligned with said third passage of said second of said second planar elements.

15. Apparatus in accordance with claim 14, wherein said first fluid flow path of each of said plurality of first and second planar elements is in the shape of:

(1) a first oblong spiral extending inward from said first point to a central area of each of said first and second planar elements, and (2) a second oblong spiral groove interlaced with said first oblong spiral groove and extending outward from the central area to said second point.

16. Apparatus in accordance with claim 14, wherein said first fluid flow path of each of said plurality of first and second planar elements is in the shape of a switch-back curve extending from said first point to said second point.

17. Apparatus in accordance with claim 1 wherein said first spiral groove and said second spiral groove are machined on said top surface of said planar element.

18. Apparatus in accordance with claim 1 wherein each of said planar elements has a thickness sufficient to be mechanically machined to form said first spiral groove and said second spiral groove.

19. Apparatus in accordance with claim 1 wherein each of said planar elements has a thickness of at least one-half inch.

20. Apparatus in accordance with claim 1 wherein said first spiral groove and said second spiral groove have an axial depth of approximately 30% to 80% of the thickness of each of said planar elements.

21. Apparatus in accordance with claim 1 wherein said first spiral groove and said second spiral groove have an axial depth of approximately 70% to 80% of the thickness of each of said planar elements.

22. Apparatus in accordance with claim 11 wherein said first, second, third and fourth circular grooves have the same cross-sectional axial depth which is less than the diameter of said first, second, third and fourth O-ring seals.

23. Apparatus in accordance with claim 11 wherein said first, second, third and fourth circular grooves have the same cross-sectional radial length which is more than the diameter of said first, second, third and fourth O-ring seals.

24. Apparatus for heating and mixing a fluid comprising:

an end plate having first and second holes extending through said end plate from a top surface to a bottom surface;

a first pipe coupling element mounted to said top surface of said end plate at said first hole;

a second pipe coupling element mounted to said top surface of said end plate at said second hole;

a plurality of planar elements each having:

(a) a first fluid flow path defined by:

(1) a first spiral groove in a top surface of said planar element extending radially inward from a first point on said planar element to a central area of said planar element, (2) a second spiral groove in said top surface of said planar element interlaced with said first spiral groove and extending radially outward from said central area of said planar element to a second point on said planar element 180° from said first point on said planar element and at the same radial distance from the center of said planar element as the radial distance between the center of said planar element and said first point on said planar element, (3) a first passage at said first point on said planar element extending into said top surface of said planar element to said first spiral groove, and (4) a second passage at said second point on said planar element extending from said second spiral groove to a bottom surface of said planar element, and (b) a second fluid flow path defined by a third passage extending through said planar element from said top surface to said bottom surface and disposed 90° from said first and second points on said planar element and at the same radial distance from the center of said planar element as the radial distance between the center of said planar element and said first and said second points on said planar element; and means for mounting said end plate and said plurality of planar elements adjacent one another wherein:

(a) said bottom surface of said end plate is in contact with said top surface of a first of said plurality of planar elements, (b) said bottom surface of said first planar element is in contact with said top surface of a second of said plurality of planar elements, (c) said first hole of said end plate is aligned with said first passage of said first planar element, (d) said second hole of said end plate is aligned with said third passage of said first planar element and said first passage of said second planar element, and (e) said second passage of said first planar element is aligned with said third passage of said second planar element.

25. A system for heating and mixing a fluid comprising:

a unit for heating and mixing a product comprising:

(a) a first end plate having first and second holes extending through said first end plate from a top surface to a bottom surface, (b) a first pipe coupling element mounted to said top surface of said first end plate at said first hole for introducing a liquid product to said unit, (c) a second pipe coupling element mounted to said top surface of said first end plate at said second hole for conducting a heating medium from said unit, (d) a second end plate having third and fourth holes extending through said second end plate from a top surface to a bottom surface, (e) a third pipe coupling element mounted to said top surface of said second end plate at said third hole for conducting said liquid product from said unit, (f) a fourth pipe coupling element mounted to said top surface of said second end plate at said fourth hole for introducing said heating medium to said unit, (g) a plurality of planar elements each having:

(1) a first fluid flow path defined by:

(i) a first spiral groove in a top surface of said planar element extending radially inward from a first point on said planar element to a central area of said planar element, (ii) a second spiral groove in said top surface of said planar element interlaced with said first spiral groove and extending radially outward from said central area of said planar element to a second point on said planar element 180° from said first point on said planar element and at the same radial distance from the center of said planar element as the radial distance between the center of said planar element and said first point on said planar element, (iii) a first passage at said first point on said planar element extending into said top surface of said planar element to said first spiral groove, and (iv) a second passage at said second point on said planar element extending from said second spiral groove to a bottom surface of said planar element, and (2) a second fluid flow path defined by a third passage extending through said planar element from said top surface to said bottom surface and disposed 90° from said first and second points on said planar element and at the same radial distance from the center of said planar element as the radial distance between the center of said planar element and said first and said second points on said planar element; and (h) means for mounting said first end plate, said plurality of planar elements and said second end plate adjacent one another wherein:

(1) said bottom surface of said end plate is in contact with said top surface of a first of said plurality of planar elements, (2) said bottom surface of said first planar element is in contact with said top surface of a second of said plurality of planar elements, (3) said first hole of said first end plate is aligned with said first passage of said first planar element, (4) said second hole of said first end plate is aligned with said third passage of said first planar element and said first passage of said second planar element, and (5) said second passage of said first planar element is aligned with said third passage of said second planar element;

a boiler, having an inlet and an outlet, for heating said heating medium discharged from said unit;

first fluid flow means, extending between said second pipe coupling element and said inlet of said boiler, for conducting said heating medium from said unit to said boiler; and second fluid flow means, extending between said outlet of said boiler and said fourth pipe coupling element, for conducting said heating medium from said boiler to said unit.

26. An apparatus as claimed in claim 1, wherein said bottom surface of each of said plurality of planar elements is substantially flat.

* * * * *

UNITED STATES PATENT AND TRADE MARK OFFICE

CERTIFICATE OF CORRECTION

PATENT NO. : 5,471,913
DATED : December 5, 1995
INVENTOR(S) : Thomas B. Margittai It is certified that error appears in the above-identified patent and that said Letters Patent is hereby corrected as shown below:

Column 12, line 7, delete "claim 2" and insert --claim 1--.

Column 12, line 38, delete "claim 4" and insert --claim 3--.

Signed and Sealed this

Second Day of April, 1996

Bruce Lehman

*Attest:*

BRUCE LEHMAN

*Attesting Officer*

*Commissioner of Patents and Trademarks*